US007716916B2

(12) United States Patent
Ellmer et al.

(10) Patent No.: US 7,716,916 B2
(45) Date of Patent: May 18, 2010

(54) METHOD FOR CONTROLLING A FUEL MIXTURE FOR AN INTERNAL COMBUSTION ENGINE AND CORRESPONDING CONTROL UNIT

(75) Inventors: Dietmar Ellmer, Regensburg (DE); Thorsten Lauer, Holzeim a. Forst (DE)

(73) Assignee: Continental Automotive GmbH, Hannover (DE)

( * ) Notice: Subject to any disclaimer, the term of this patent is extended or adjusted under 35 U.S.C. 154(b) by 1110 days.

(21) Appl. No.: 10/544,148

(22) PCT Filed: Sep. 2, 2004

(86) PCT No.: PCT/EP2004/052012

§ 371 (c)(1),
(2), (4) Date: Aug. 2, 2005

(87) PCT Pub. No.: WO2005/024211

PCT Pub. Date: Mar. 17, 2005

(65) Prior Publication Data

US 2006/0150615 A1 Jul. 13, 2006

(30) Foreign Application Priority Data

Sep. 4, 2003 (DE) ..... 103 40 815

(51) Int. Cl.
*F01N 3/00* (2006.01)

(52) U.S. Cl. ..... 60/285; 60/274; 60/276

(58) Field of Classification Search ..... 60/274, 60/276, 277, 285
See application file for complete search history.

(56) References Cited

U.S. PATENT DOCUMENTS

| | | | | |
|---|---|---|---|---|
| 5,842,340 | A * | 12/1998 | Bush et al. | 60/274 |
| 6,105,366 | A | 8/2000 | Zhang | |
| 6,571,550 | B2 * | 6/2003 | Rosel et al. | 60/285 |
| 6,655,129 | B2 * | 12/2003 | Lindner et al. | 60/277 |

FOREIGN PATENT DOCUMENTS

| | | | |
|---|---|---|---|
| DE | 43 22 341 | A1 | 1/1994 |
| DE | 197 52 965 | A1 | 6/1999 |
| DE | 102 06 399 | C1 | 5/2003 |
| DE | 10206399 | * | 5/2003 |
| EP | 0 972 928 | A1 | 1/2000 |

* cited by examiner

*Primary Examiner*—Thomas E Denion
*Assistant Examiner*—Diem Tran
(74) *Attorney, Agent, or Firm*—King & Spalding L.L.P.

(57) ABSTRACT

The invention relates to a method for regulating the mixture in an internal combustion engine by means of a catalytic converter and a lambda probe that is placed downstream of the catalytic converter. Depending on the historical signal values, said method determines whether intervention in the formation of the mixture is required, whether the existing signal is only decreasing slowly, which necessitates slow regulatory intervention, or whether the signal of the probe placed downstream of the catalytic converter decreases rapidly, which necessitates rapid regulatory intervention. The difference types of intervention enable the volume of the catalytic converter to be reduced, thus preventing high consumption in the warm-up phase or the poor start-up behavior of large catalytic converters.

20 Claims, 1 Drawing Sheet

METHOD FOR CONTROLLING A FUEL MIXTURE FOR AN INTERNAL COMBUSTION ENGINE AND CORRESPONDING CONTROL UNIT

CROSS REFERENCE TO RELATED APPLICATIONS

This application is the U.S. National Stage of International Application No. PCT/EP2004/052012, filed Sep. 2, 2004 and claims the benefit thereof. The International Application claims the Benefits of German application No. 10340815.0, filed Sep. 4, 2003. The International Application and the German application are incorporated by reference herein in their entirety.

FIELD OF THE INVENTION

The present invention relates to a method for mixture control in an internal combustion engine with a catalytic converter and a lambda probe downstream of said catalytic converter.

BACKGROUND OF THE INVENTION

DE 102 06 399 C1 discloses a method for forced activation of a lambda control system which improves exhaust gas conversion in the case of a three-way catalytic converter, wherein mixture control having alternately rich and lean exhaust gas packets is performed varyingly around a lambda setpoint value. For particularly reliable exhaust gas conversion, so-called fine dosing of the exhaust gas packets is performed.

SUMMARY OF THE INVENTION

To improve exhaust gas conversion still further, efforts are made to reduce the size of the catalytic converter, as although a large catalytic converter allows good buffering of mixture faults, it requires a large amount of energy in the heating-up phase and exhibits poor starting behavior.

An object of the invention is to provide a method of mixture control which reliably ensures high conversion quality even with reduced size catalytic converters.

This object is achieved by the claims.

With the method according to the invention, a control unit successively reads in the lambda values measured by the lambda probe and compares the current lambda value with a previously read-in lambda value. If the comparison indicates a fall in the lambda value, the control unit can initiate a mixture change. This mixture change is initiated if the lambda value has fallen by or by more than a predefined constant. To this end the change in the lambda value is compared with the constant. A lambda value falling by more than a predefined constant indicates that catalytic converter breakdown is imminent, and so direct intervention in the formation of the mixture takes place via the control unit. On the other hand, if the lambda value falls by less than the predefined constant, the control unit initiates a check to ascertain whether the lambda value continues to fall for a number of subsequent measured values. In this checking mode, also known as dynamic mode, intervention in the mixture formation process does not therefore takes place immediately. This method allows unnecessary interventions in mixture formation to be reduced, thereby making it possible for the size of the catalytic converter to be reduced while at the same time ensuring reliable exhaust gas conversion.

In a preferred embodiment, a reference value is calculated from the current lambda value during checking of the subsequent measured values and a mixture change is initiated if firstly more than a minimum number of measured values have been checked and secondly if the reference value is less than a predefined constant. Intervention does not therefore occur in the event that the reference value is greater than the predetermined constant or a minimum number of measured values has not yet been checked since the first fall in the lambda signal. The above conditions ensure that not every control intervention in mixture formation is suppressed in checking mode, but that intervention only occurs under particular conditions.

It has also been found advantageous to define a minimum value and a maximum value for the lambda values. These values are preferably determined as a function of the operating state, in particular of the air mass flow and/or RPM. The reference value is then obtained as the quotient of the current lambda value minus the minimum value divided by the difference between the maximum value and minimum value. In this definition, the reference value thus defined can become greater than 1 and less than 0. If the values of the current lambda value are greater than or equal to the maximum value, the reference value will be greater than or equal to 1. If the current lambda value is less than the minimum value, the reference value will be negative.

In monitoring mode, intervention in mixture formation preferably occurs by changing the frequency and/or amplitude of a forced activation. In a preferred embodiment, intervention in the mixture change is implemented by suppressing the lean exhaust gas packets of the forced activation. A slight increase in the mean value therefore occurs via the forced activation. Therefore, if a slow fall in the lambda value is determined in monitoring mode, slow intervention in mixture formation takes place if the reference variable shows corresponding values and a minimum time has elapsed since the last fall.

In a preferred embodiment, checking of the subsequent measured values is terminated if the lambda values does not continue to fall within a predefined number of measured values. The resetting of dynamic mode ensures that signal changes occurring much later are no longer interpreted against the background of the earlier signal change. In a possible further development of the method according to the invention, the constants, e.g. the constants for the fall in the lambda values, the number of measured values to be checked and/or the minimum number of measured values required for initiating intervention in dynamic mode, are determined as a function of the operating point. It is conceivable for all constants, combinations of constants or only a single constant to be determined on an operating point dependent basis. Operating point dependence is preferably based on the current exhaust gas composition.

The monitoring duration and the number of lambda values to be monitored can be implemented as function of time, specified as a physical time duration or on a segment-dependent basis in relation to the exhaust gas packets. It is also possible to make the duration dependent on the oxygen mass balance.

BRIEF DESCRIPTION OF THE DRAWING

The method according to the invention will now be explained in greater detail with reference to the accompanying drawings in which.

DETAILED DESCRIPTION OF THE INVENTION

Figure 1:
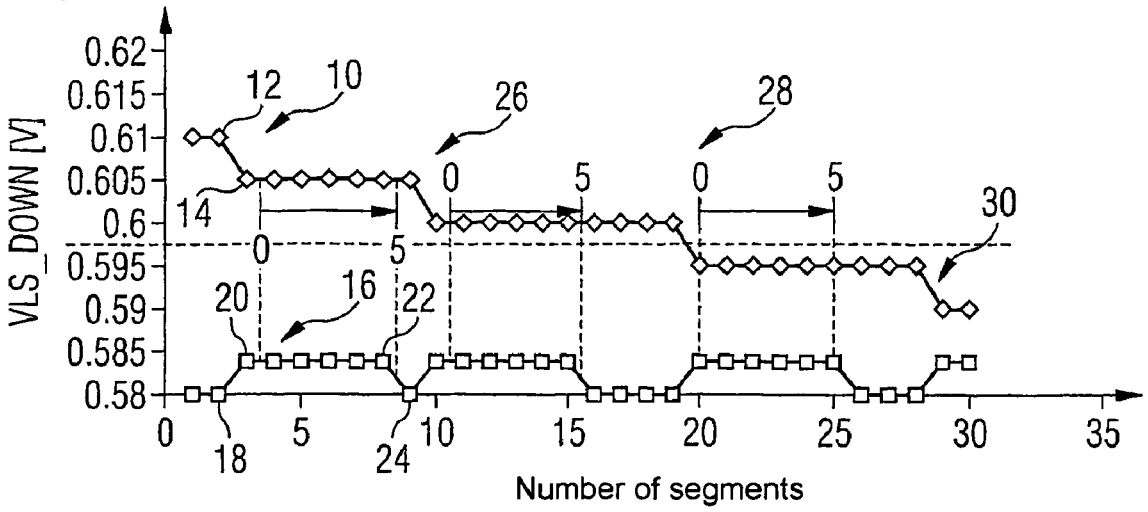
FIG. 1 shows a slowly falling lambda signal for which no control intervention occurs.

FIG. 1 shows the sequence of the post-cat signals 10 over the number of segments. The post-cat sensor is a binary sensor whose signals are analyzed in the transition range of rich and lean mixture formation. The measured post-cat signal VLS_DOWN is set in relation with two operating point dependent maximum and minimum values. The maximum value VLS_DOWN_MAX and the minimum value VL_DOWN_MIN preferably depend on the current mass air flow (MAF) and the engine speed (N). Using the minimum and maximum value, a reference value FAC_VLS_DOWN is determined. The reference value is calculated according to the following formula:

$$\text{FAC_VLS_DOWN} = \frac{\text{VLS_DOWN} - \text{VLS_DOWN_MIN}}{\text{VLS_DOWN_MAX} - \text{VLS_DOWN_MIN}}$$

The reference value assumes values less than 0 when VLS_DOWN is less than VLS_DOWN_MIN. If the current lambda value is greater than the maximum value (VLS_DOWN>VLS_DOWN_MAX), values greater than 1 may also occur.

In the course of the method it is established whether a falling VLS_DOWN signal of the post-cat sensor is present. To this end the current VLS_DOWN value (VLS_DOWN) is compared with the previous VLS_DOWN value (VLS_DOWN_OLD). If the current value has fallen compared to the previous lambda value, the relevant gradient is calculated:

$$VLS_DOWN_GRD = VLS_DOWN_OLD - VLS_DOWN$$

With the above sign convention, a positive gradient (VLS_DOWN_GRD>0) means that the post-cat sensor-signals are falling. A rising gradient therefore means an increasing fall in the signal. In order to ascertain whether an increasing fall in the signal is present, the gradient is compared with a previous gradient (VLS_DOWN_GRD_OLD). If the gradient is found to have increased, a flag indicating dynamic mode is set:

LV_VLS_DOWN_DYN=TRUE.

As long as the dynamic state is set, the value for the past gradient (VLS_DOWN_GRD_OLD) is only overwritten if a current gradient genuinely greater than 0 occurs. If a plurality of measured values with constant post-cat sensor signals (VLS_DOWN_GRD=0) come after the dynamic state has been set, the past gradient of the post-cat signals is not overwritten. Only if a rising gradient (VLS_DOWN_GRD>0) occurs is the past gradient (VLS_DOWN_GRD_OLD) overwritten with a new value for the gradient.

The method according to the invention will now be explained in further detail with reference to the following examples:

After a first detection of a falling post-cat sensor signal VLS_DOWN, a counter is incremented with each segment (CTR_VLS_DOWN_CONST). The counter is then compared with a predefined constant C_CTR_VLS_DOWN_CONST. If the counter is greater than the constant, the dynamic state LV_VLS_DOWN_DYN is reset and the counter CTR_VLS_DOWN_CONST is re-zeroed. This means that the dynamic state is maintained for a certain time or a certain number of segments (C_CTR_VLS_DOWN_CONST). If the post-cat sensor signal falls no further during this time, no dynamic state will be present and no control intervention will occur. A slow fall in the post-cat sensor signal relative to the constant C_CTR_VLS_DOWN_CONST is not recognized as a critical dynamic and is handled by a function described further below.

FIG. 1 explains the above-described case in greater detail. In transition from measured value 12 to measured value 14, the post-cat sensor signal falls and the counter is incremented. The dynamic bit 16 is simultaneously set to 1 (=TRUE) with the transition from 18 to 20. In the subsequent segments the counter (CTR_VLS_DOWN_CONST) is incremented and the dynamic bit 16 is again reset for the transition from 22 to 24 if the predefined constant (5 segments in the example shown) is exceeded. As shown in FIG. 1, in the event of a subsequent drop in the measured post-cat sensor signals 26, 28, 30, no control intervention is initiated, as the interval between the falling signals is always greater than the predetermined duration of five segments.

Figure 2:
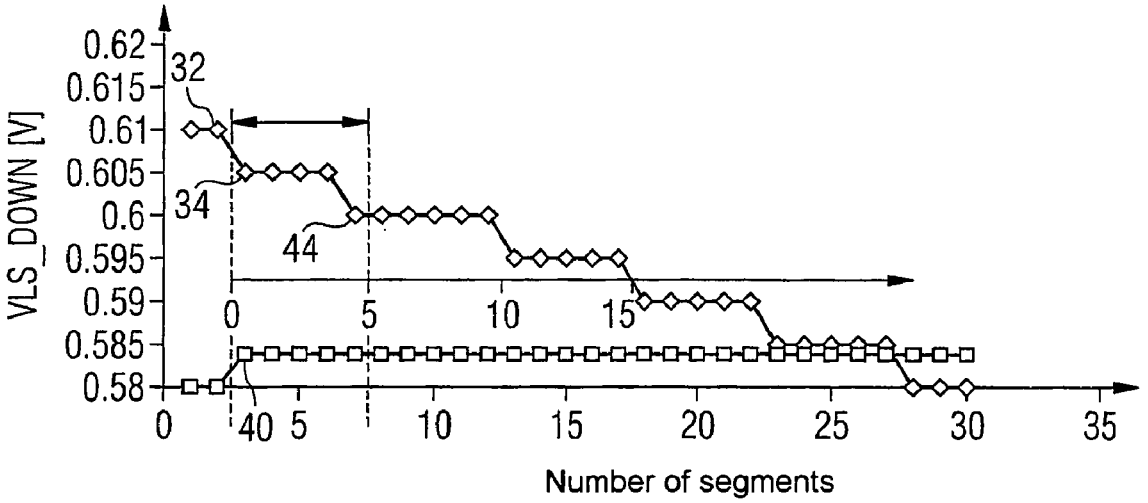
FIG. 2 shows a slowly falling lambda signal for which control intervention occurs via forced activation.
Figure 3:
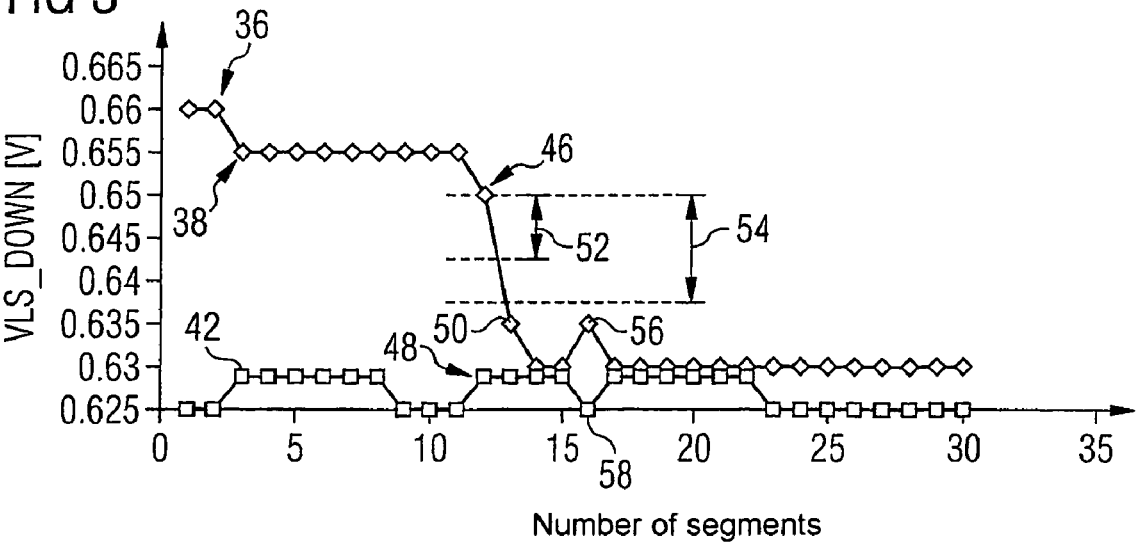
FIG. 3 shows a heavily falling lambda signal initiating immediate control intervention.

Now referring to FIGS. 2 and 3, as the result the falling post-cat sensor signals 32, 34 in FIG. 2 or 36, 38 in FIG. 3, the dynamic state is activated. The dynamic indicating bit LV_VLS_DOWN_DYN_DOWN is set to 1 in 40 or 42. In dynamic mode the counter CTR_VLS_DOWN_DYN is incremented with each segment. In the example shown in FIG. 2 the post-cat sensor signal 44 continues to fall. In this case a control intervention takes place, tending to prevent all lean exhaust gas packets of the forced activation of the catalytic converter. As already explained above, in the case of a three-way catalytic converter, a good conversion rate requires forced activation whereby slightly lean and slightly rich exhaust gas packets are used alternately according to a particular pattern. Deactivation of the lean packets therefore ensures a richer total mixture averaged over time. Control intervention occurs if both the following conditions are met:

CTR_VLS_DOWN_DYN>C_CTR_VLS_DYN_THD
and

FAC_VLS_DOWN<C_FAC_VLS_DOWN_DYN.

The first part of the condition ensures that control intervention only takes place if the second falling post-cat sensor signal 44 occurs after a minimum number of segments after the first fall 34. The minimum number of segments is denoted as constant C_CTR_VLS_DYN_THD. In addition, control intervention only occurs if the reference value FAC_VLS_DOWN is less than a predefined constant C_FAC_VLS_DOWN_DYN. In the example shown in FIG. 2, the slight fall in the post-cat sensor signal 44 therefore causes a control intervention which only suppresses the lean exhaust gas packets of the forced activation and therefore slowly results in riching averaged over time. By his means it is possible to respond to a slow fall in the post-cat sensor signals by a slow intervention.

The example illustrated in FIG. 3 shows how an initial fall in the post-cat sensor signal 46 activates dynamic mode 48. With dynamic mode activated, in the example in FIG. 3 the post-cat sensor signal 50 continues to falls. If this fall fulfills the condition:

VLS_DOWN_GRD>C_VLS_DOWN_GRD_DYN, rapid intervention by the control system is initiated. This intervention is also initiated if the post-cat sensor signal were to fall directly from 46 to 50. In FIG. 3 the constant C_VLS_DOWN_GRD_DYN is plotted as the interval 52 relative to the signal value 46. The gradient resulting from the values 46 and 50 is shown as interval 54. The rapid fall in the post-cat sensor signals illustrated in FIG. 3 necessitates rapid intervention in mixture formation. This intervention is initiated in the conventional manner. FIG. 3 likewise shows that the rising post-cat signal 56 has the direct result of resetting the dynamic state 58.

In the example shown in FIG. 3 the post-cat signal 56 rises after control intervention has taken place so that regular operation is then resumed due to the reset dynamic mode 58.

Not shown in the Figures is the fact that the constants C_CTR_VLS_DOWN_CONST, C_CTR_VLS_DYN_THD, C_FAC_VLS_DOWN_DYN and C_VLS_DOWN_GRD_DYN may depend on other physical and chemical variables. These variables can be determined directly or with the aid of modeling. For example, the operating point dependent exhaust gas composition can be used as the basis for calculating these constants.

As a result of the method described, individual bit changes in the post-cat sensor signal are evaluated differently in the case of a binary post-cat sensor. A VLS_DOWN_SIGNAL which is slowly falling or rising again in between is not deemed to be "dynamic". It does not necessitate any control intervention. If the signal falls somewhat more quickly, intervention takes place, preferably as a function of the operating point dependent positions of the absolute value of the post-cat sensor signal. If the signal falls very quickly, intervention takes place immediately. The controller speed is therefore dependent on the operating point of the engine, in particular the mass air flow (MAF) and the engine speed (N), and the state or operating point (VLS_DOWN) of the catalytic converter.

In the above examples, the counter CTR_VLS_DOWN_DYN was based on a segment-synchronous calculation. However, it is also conceivable for a time-synchronous calculation to used as the basis or to relate to the oxygen mass balancing. Another option is to relate the threshold to an exhaust gas quantity. It is alternatively possible to assign the actual lambda value from the pre-cat signal to a quantity of oxygen or other exhaust gas component and use this as a reference for the constants.

The invention claimed is:

1. A method for controlling a fuel mixture provided for an internal combustion engine generating a flue gas stream by combusting the mixture, the engine comprising a catalytic converter arranged in the flue gas stream and a lambda probe arranged downstream of the converter relative to the fuel gas stream for providing post-cat sensor signals, the method comprising:

detecting a post-cat sensor signal by the lambda probe;

acquiring a subsequent post-cat sensor signal chronologically succeeding the post-cat sensor signal by the lambda probe;

generating a comparative value by comparing the acquired subsequent post-cat sensor signal to the detected post-cat sensor signal;

changing the mixture if the comparative value is greater than or equal to a predetermined value; and generating a number of chronologically succeeding comparative values by repeating the detecting and the acquiring steps, and checking a trend of the succeeding comparative values.

2. The method according to claim 1, wherein the comparative value is a difference value between the post-cat sensor signal and the subsequent post-cat sensor signal.

3. The method according to claim 1, wherein changing the mixture includes changing a frequency or an amplitude of a forced activation of the catalytic converter.

4. The method according to claim 1, the flue gas stream comprising segments having rich and lean exhaust gas packets, wherein changing the mixture includes a suppression of the lean exhaust gas packets.

5. The method according to claim 1, wherein generating the number of succeeding comparative values or checking the trend is executed during a predetermined period.

6. The method according to claim 1, wherein generating the number of succeeding comparative values or checking the trend is executed during a period based on the segments of the flue gas stream.

7. The method according to claim 1, wherein generating the number of succeeding comparative values or checking the trend is based on an oxygen mass balance of the combustion.

8. The method according to claim 1, wherein checking the trend comprises calculating a calculated value based on the post-cat and the subsequent post cat sensor signals.

9. The method according to claim 8, wherein the method further comprises a further changing the mixture if the number of succeeding comparative values exceeds a minimum number and the calculated value is less than the predetermined value.

10. The method according to claim 8, wherein the calculating includes defining a minimum post-cat sensor signal and a maximum post-cat sensor signal and dividing a difference value between the detected post-cat sensor signal and the minimum post-cat sensor signal by a difference value between the maximum post-cat sensor signal and the minimum post-cat sensor signal.

11. The method according to claim 10, wherein defining the minimum and the maximum post-cat sensor signals is based on a current mass air flow or an engine speed.

12. The method according to claim 9, wherein the minimum number is based on at least one operating point of the engine.

13. The method according to claim 12, wherein the operating point is based on a current exhaust gas composition of the flue gas stream.

14. The method according to claim 1, wherein checking the trend includes comparing the subsequent post-cat sensor signals used for generating the number of the succeeding comparative values.

15. The method according to claim 14, wherein checking the trend is stopped if the compared subsequent post-cat sensor signals are substantially equal.

16. The method according to claim 1, wherein the predetermined value or the number of succeeding comparative values is based on at least one operating point of the engine.

17. The method according to claim 16, wherein the operating point is based on a current exhaust gas composition of the flue gas stream.

18. A control unit for controlling a fuel mixture provided for internal combustion engine generating a flue gas stream by combusting the mixture, the engine comprising a catalytic converter arranged in the flue gas stream and a lambda probe arranged downstream of the converter relative to the fuel gas stream for providing post-cat sensor signals, wherein the control unit is configured for:

detecting a post-cat sensor signal by the lambda probe;

acquiring a subsequent post-cat sensor signal chronologically succeeding the post-cat sensor signal by the lambda probe;

generating a comparative value by comparing the acquired subsequent post-cat sensor signal to the detected post-cat sensor signal;

changing the mixture if the comparative value is greater than or equal to a predetermined value; and generating a number of chronologically succeeding comparative values by repeating the detecting and the acquiring steps, and checking a trend of the succeeding comparative values, and wherein the control unit is operatively connectable to the lambda probe for detecting the post-cat sensor signal and acquiring the subsequent post-cat sensor signal.

19. The control unit according to claim 18, the control unit is adapted such the detecting and the acquiring is executable by reading the post-cat and the subsequent post-cat sensor signals.

20. The control unit according to claim 18, the control unit is configured for generating the comparative value, changing the mixture, generating the number of succeeding comparative values or checking the trend.

* * * * *